US011242115B1

(12) United States Patent
Jalala

(10) Patent No.: US 11,242,115 B1
(45) Date of Patent: Feb. 8, 2022

(54) BOAT STABILIZER

(71) Applicant: Farid Jalala, Anaheim, CA (US)

(72) Inventor: Farid Jalala, Anaheim, CA (US)

( * ) Notice: Subject to any disclaimer, the term of this patent is extended or adjusted under 35 U.S.C. 154(b) by 0 days.

(21) Appl. No.: 17/339,882

(22) Filed: Jun. 4, 2021

(51) Int. Cl.

| | |
|---|---|
| ***B63B 1/30*** | (2006.01) |
| ***B63B 39/06*** | (2006.01) |
| ***B63B 1/28*** | (2006.01) |
| ***B63B 1/26*** | (2006.01) |

(52) U.S. Cl.
CPC ..... *B63B 1/30* (2013.01); *B63B 1/26* (2013.01); *B63B 1/28* (2013.01); *B63B 1/285* (2013.01); *B63B 39/06* (2013.01); *B63B 39/062* (2013.01); *B63B 2001/281* (2013.01)

(58) Field of Classification Search
CPC ..... B63B 1/24; B63B 1/242; B63B 1/244; B63B 1/246; B63B 1/248; B63B 1/26; B63B 1/28; B63B 2001/281; B63B 1/285; B63B 1/286; B63B 1/30; B63B 39/06; B63B 39/061; B63B 39/062
See application file for complete search history.

(56) References Cited

U.S. PATENT DOCUMENTS

| | | | | |
|---|---|---|---|---|
| 2,584,347 A * | 2/1952 | Hazard | B63B 1/285 | 114/280 |
| 3,150,626 A * | 9/1964 | Irgens | B63B 1/30 | 114/282 |
| 5,117,776 A * | 6/1992 | Thorpe | B63B 1/30 | 114/282 |
| 7,743,720 B1 * | 6/2010 | Salani | B63B 1/285 | 114/61.1 |

* cited by examiner

*Primary Examiner* — Ajay Vasudeva
(74) *Attorney, Agent, or Firm* — Cionca IP Law P.C.; Marin Cionca

(57) ABSTRACT

A boat stabilizer having an upper harness for attachment to a vessel having bow, stern, port and starboard sides; the upper harness having: four beams forming a rectangular shape with four corners, each beam running along a different side of the vessel, a rudder and an assembly control system and four wing assemblies, each one attached to the assembly control system and the upper harness and having a rod junction connected to the upper harness, two rods connected to the rod junction, a wing connected to the two rods, and a wing mount attached to the wing by a wing pole and the upper harness by a control pole. The assembly control system may adjust wing pitch angle and rotate the wing assemblies to and from the water. Adjustment of wing angles may increase stability, reduce wear and tear, increase fuel efficiency, and maintain vessel safety.

20 Claims, 13 Drawing Sheets

BOAT STABILIZER

STATEMENT REGARDING FEDERALLY SPONSORED RESEARCH OR DEVELOPMENT

Not Applicable

REFERENCE TO SEQUENCE LISTING, A TABLE, OR A COMPUTER PROGRAM LISTING COMPACT DISC APPENDIX

Not Applicable

BACKGROUND OF INVENTION

1. Field of the Invention

The invention relates generally to nautical equipment and specifically to a stabilization device for nautical vessels.

2. Description of the Related Art

Conventional nautical vessels often experience an array of challenges during travel that affect their stability, efficiency, safety, passenger comfort, vessel longevity and thus their general viability as a means of travel in many environments. Turbulent waters and strong winds will often rock vessels, potentially violently, resulting in unsafe conditions that may capsize or damage the vessel. Even in less extreme conditions, the rocking of the vessel as a result of the wind or waves may result in seasickness for susceptible passengers. Additionally, the significant amount of drag exerted on the vessel's hull by the surrounding water during travel requires that a significant amount of force be used to propel it, resulting in slow speeds and short travel distances, as well as lower fuel efficiencies on powered vessels. Due to these shortcomings, several technologies have emerged in order to provide potential solutions.

Incorporation of hydrofoils into vessels to provide additional lift during travel may help alleviate some of the issues present for some conventional nautical vessels, but this technology has its limitations. Hydrofoils are typically incorporated as a permanent, non-adjustable part of the vessel, limiting the application of these vessels, especially in shallow waters or where subsurface vertical clearance is a concern due to aquatic flora, fauna or other hazards. The lift provided by a non-adjustable hydrofoil may not be helpful or even safe in instances where the effects of strong winds or turbulent waters may be exacerbated by the supplied lift force. Additionally, the unibody design of some hydrofoils can make replacement and maintenance of the device costly and difficult. Therefore, there is a need to provide a boat stabilizer system and method that provide solutions to the issues and shortcomings of the prior art detailed above.

The aspects or the problems and the associated solutions presented in this section could be or could have been pursued; they are not necessarily approaches that have been previously conceived or pursued. Therefore, unless otherwise indicated, it should not be assumed that any of the approaches presented in this section qualify as prior art merely by virtue of their presence in this section of the application.

BRIEF INVENTION SUMMARY

This Summary is provided to introduce a selection of concepts in a simplified form that are further described below in the Detailed Description. This Summary is not intended to identify key aspects or essential aspects of the claimed subject matter. Moreover, this Summary is not intended for use as an aid in determining the scope of the claimed subject matter.

In an aspect, a boat stabilizer is provided, the boat stabilizer comprising: an upper harness for attachment to a vessel, the vessel having a bow side, a stern side, a port side and a starboard side; the upper harness having: a bow beam running straight across the bow side of the vessel and beyond the port and starboard sides of the vessel, terminating in port and starboard end sections respectively; a stern beam running straight across the stern side of the vessel and beyond the port and starboard sides of the vessel, terminating in port and starboard end sections respectively; a port beam connecting the port side end sections of the bow and stern beams; a starboard beam connecting the starboard side end sections of the bow and stern beams; an assembly control system having four orientation locks, each one attached to a different end section and comprising a rotation couple, a locking key and a locking screw, and two wing angle controllers, each having a base and a handle, with the base attached to one of the upper harness beams and the handle attached to the base and four wing assemblies, each one attached to a different orientation lock and comprising: a rod junction, having an upper central portion attached to a corresponding wing angle controller by a control pivot joint, a front end pivot joint and a back end pivot joint; a front rod and a back rod, each rod having a top portion attached to a corresponding end pivot joint, a middle section and a bottom section; a wing having a front portion, a back portion, a central mount located between the front and back portion, a front mount on the front portion and attached to the bottom section of the front rod, and a back mount on the back portion attached to the back rod by the bottom section of the back rod; a wing pole having a bottom end attached to the central mount by a wing pivot joint, and a top end; a wing mount attached to the wing pole, the wing mount having a bottom part, a front part having a sharpened edge, a back part, a top part, a front slot surrounding the middle section of the front rod, and a back slot surrounding the middle section of the back rod and a control pole having a bottom end attached to the top part of the wing mount and top end attached to the rotation couple of the corresponding orientation lock; wherein each wing angle controller is configured to adjust pitch angles of their respective wings through manipulation of the wing angle controller handle; wherein each orientation lock is configured to rotate the attached wing assembly through manipulation of the corresponding locking key and locking screw; wherein the sharpened edges of the wing mounts face the same direction as the bow of the vessel when the wing assemblies are rotated below the vessel. One advantage is that as the vessel travels forward a lift force will be applied on the wings and thus, the attached vessel, raising it out of the water, resulting in a reduced turbulence from being risen above some waves, preventing or lessening seasickness in passengers. Another advantage of the supplied lift is that it may increase speed, fuel milage and/or travel distance of the vessel as a result of reducing the amount of drag experienced by the vessel by the surrounding water during travel. Another advantage is that vessel longevity may be increased as a result of decreased impact force and frequency from waves as a result of the supplied lift. Another advantage is that the wing angles may be adjusted to keep the vessel steady and upright during strong winds, turbulent waters or other hazardous conditions. Another advantage is that this technology may be applied to a vessel with only minor modifications and may be deployed or withdrawn at will.

In an aspect, a boat stabilizer is provided, the boat stabilizer comprising: an upper harness having: a body comprised of a plurality of interconnected beams and an assembly control system having two wing angle controllers and four orientation locks and four wing assemblies attached to the body, each comprising: a rod junction, having an upper central portion attached to a corresponding wing angle controller, a front end pivot joint and a back end pivot joint; a front rod and a back rod, each rod having a top portion attached to a corresponding end pivot joint, a middle section and a bottom section; a wing having a front portion, a back portion, a central mount located between the front and back portion, a front mount on the front portion and attached to the bottom section of the front rod, and a back mount on the back portion attached to the back rod by the bottom section of the back rod; a wing pole having a bottom end attached to the central mount by a wing pivot joint, and a top end; a wing mount attached to the wing pole, the wing mount having a bottom part, a front part, a back part, a top part and two slots, each slot surrounding a different rod by the middle section and a control pole having a bottom end attached to the top part of the wing mount and top end attached to the orientation lock; wherein each wing angle controller is configured to adjust pitch angles of their respective wings and wherein each orientation lock is configured to rotate the attached wing assembly. Again, an advantage is that as an attached vessel travels forward a lift force will be applied on the wings and thus, the attached vessel, raising it out of the water, resulting in a reduced turbulence from being risen above some waves, preventing or lessening seasickness in passengers. Another advantage of the supplied lift is that it may increase vessel speeds, fuel milage and/or travel distance as a result of reducing the drag experienced by the vessel during travel. Another advantage is that vessel longevity may increase as a result of the decreased impact force and frequency from waves as a result of the supplied lift. Another advantage is that the wing angles may be adjusted to keep the vessel steady, upright and level during strong winds, turbulent waters or other hazardous conditions. Another advantage is that this technology may be applied to a vessel with only minor modifications and may be deployed or withdrawn at will.

In an aspect, A boat stabilizer is provided, the boat stabilizer comprising: an upper harness having: a body and an assembly control system having two wing angle controllers and four orientation locks and four wing assemblies attached to the body, each comprising: a rod junction, having an upper central portion attached to a corresponding wing angle controller, a front end couple and a back end couple; a front rod and a back rod, each rod having a top portion attached to a corresponding end couple, a middle section and a bottom section; a wing having a front portion, a back portion, a central mount located between the front and back portion, a front mount on the front portion and attached to the bottom section of the front rod, and a back mount on the back portion attached to the back rod by the bottom section of the back rod; a wing pole having a bottom end attached to the central mount and a top end; a wing mount attached to the wing pole, the wing mount having a bottom part, a front part, a back part and a top part and a control pole having a bottom end attached to the top part of the wing mount and top end attached to the orientation lock; wherein the assembly control system is configured to adjust a pitch angle of each of the wings and to rotate each of the wing assemblies in and out of water. Again, an advantage is that as an attached vessel travels forward a lift force will be applied on the wings and thus, the attached vessel, raising it out of the water, resulting in a reduced turbulence from being risen above some waves, preventing or lessening seasickness in passengers. Another advantage is that the wings may be adjusted to compensate for hazardous conditions, such as high winds and strong waves, to maintain vessel stability and prevent capsizing.

The above aspects or examples and advantages, as well as other aspects or examples and advantages, will become apparent from the ensuing description and accompanying drawings.

BRIEF DESCRIPTION OF THE DRAWINGS

For exemplification purposes, and not for limitation purposes, aspects, embodiments or examples of the invention are illustrated in the figures of the accompanying drawings, in which.

DETAILED DESCRIPTION

Figure 1:
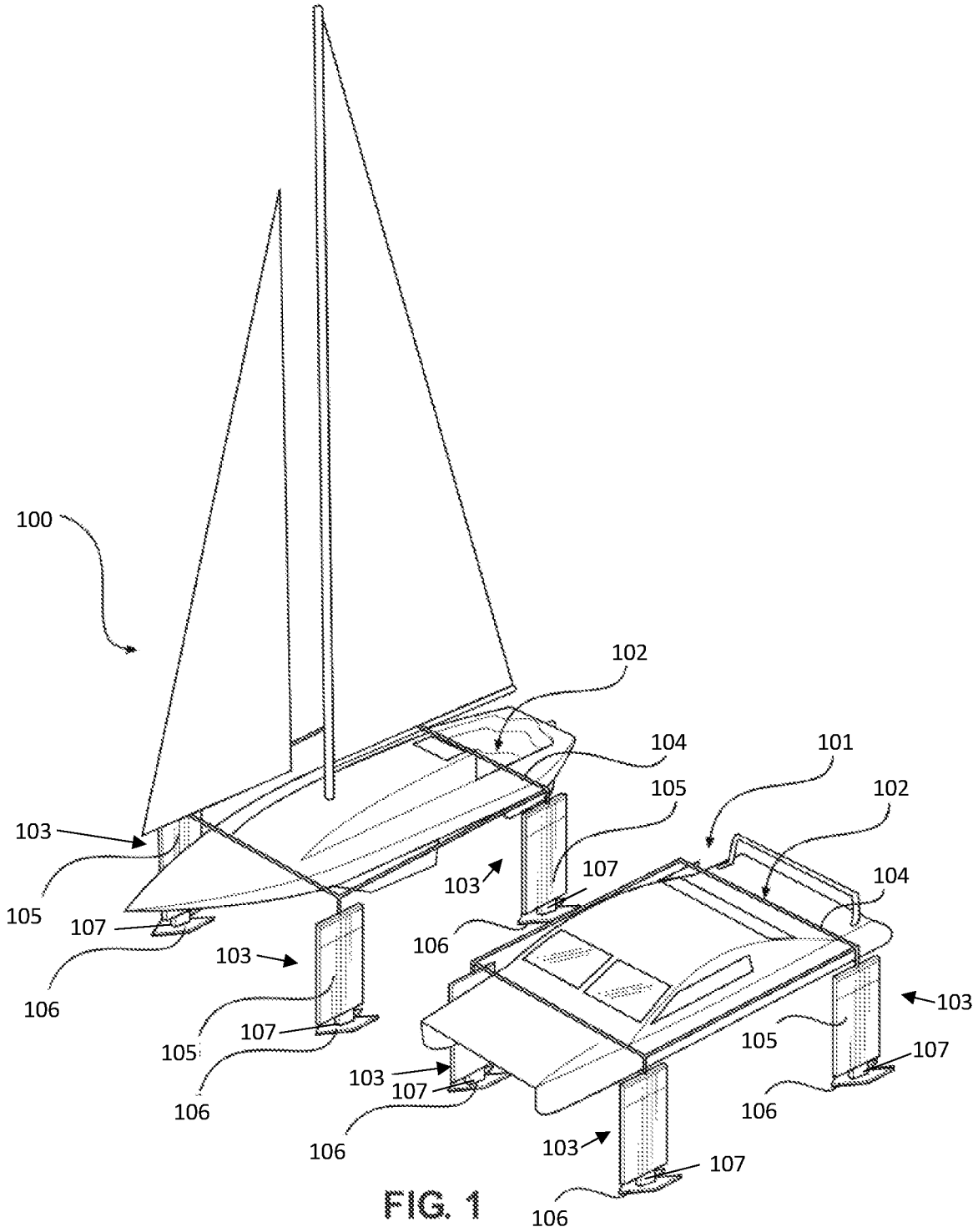
FIG. 1 illustrates the top perspective view of two boats, one being a sailboat, the other being a motorboat, each with a boat stabilizer installed, according to an aspect.

What follows is a description of various aspects, embodiments and/or examples in which the invention may be practiced. Reference will be made to the attached drawings, and the information included in the drawings is part of this detailed description. The aspects, embodiments and/or examples described herein are presented for exemplification purposes, and not for limitation purposes. It should be understood that structural and/or logical modifications could be made by someone of ordinary skills in the art without departing from the scope of the invention. Therefore, the scope of the invention is defined by the accompanying claims and their equivalents.

It should be understood that, for clarity of the drawings and of the specification, some or all details about some structural components or steps that are known in the art are not shown or described if they are not necessary for the invention to be understood by one of ordinary skills in the art.

For the following description, it can be assumed that most correspondingly labeled elements across the figures (e.g., 105 and 205, etc.) possess the same characteristics and are subject to the same structure and function. If there is a difference between correspondingly labeled elements that is not pointed out, and this difference results in a non-corresponding structure or function of an element for a particular embodiment, example or aspect, then the conflicting description given for that particular embodiment, example or aspect shall govern.

FIG. 1 illustrates the top perspective view of two boats, one being a sailboat 100, the other being a motorboat 101, each having a boat stabilizer 102 installed, according to an aspect. A boat stabilizer 102 is provided, the boat stabilizer comprising: an upper harness 104 for attachment to a vessel having: a bow beam running straight across the bow side of the vessel and beyond the port and starboard sides of the vessel, terminating in port and starboard end sections respectively; a stern beam running straight across the stern side of the vessel and beyond the port and starboard sides of the vessel, terminating in port and starboard end sections respectively; a port beam connecting the port side end sections of the bow and stern beams; a starboard beam connecting the starboard side end sections of the bow and stern beams; an assembly control system (not shown) having four orientation locks, each one attached to a different end section and comprising a rotation couple, a locking key and a locking screw, and two wing angle controllers, each having a base and a handle, with the base attached to one of the upper harness beams and the handle attached to the base and four wing assemblies 103, each one attached to a different orientation lock and comprising: a rod junction (not shown), having an upper central portion attached to a corresponding wing angle controller by a control pivot joint (not shown), a front end pivot joint and a back end pivot joint; a front rod and a back rod (not shown), each rod having a top portion attached to a corresponding end pivot joint, a middle section and a bottom section; a wing 106 having a front portion, a back portion, a central mount located between the front and back portion, a front mount on the front portion and attached to the bottom section of the front rod, and a back mount on the back portion attached to the back rod by the bottom section of the back rod; a wing pole 107 having a bottom end attached to the central mount by a wing pivot joint (not shown), and a top end; a wing mount 105 attached to the wing pole 107, the wing mount having a bottom part, a front part having a sharpened edge, a back part, a top part, a front slot surrounding the middle section of the front rod, and a back slot surrounding the middle section of the back rod and a control pole (not shown) having a bottom end attached to the top part of the wing mount and top end attached to the rotation couple of the corresponding orientation lock.

The boat stabilizer 102 described herein may be installed on a variety of different types of vessels with only minor modifications needed. The benefits afforded from the implementation of this boat stabilizer 102 may provide significant advantages to most vessels, regardless of size or propulsion method. The wing assemblies 103 may be rotated by the implemented assembly control system (not shown) such that the attached wings 106 are fully deployed below the vessel, in their operational position, or surfaced along the port and starboard sides of the vessel, in their non-operational position through manipulation of their respective orientation locks (not shown). When the wing assemblies 103 are rotated into the water, sharpened leading edges on the front part of the attached wing mounts may be facing in the intended travel direction, in order to take advantage of their superior hydrodynamic properties, as well as protect the rods from the force of the passing water as the vessel travels. The wing mounts 105 are attached to their respective wings 106 by wing poles 107 using pivot joints (not shown), such that wing mounts always retain their desired orientation, despite the angling of the wings. The rotational capability of the wing assemblies 103 allows the boat stabilizer 102 to deploy its wing assemblies as needed, affording the attached vessel enhanced versatility depending on the operation environment. The pitch angle of the wings 106 may be adjusted through manipulation of the proper wing pitch controller (not shown) located on the upper harness 104 Cables (not shown) incorporated in the assembly control system and located on the upper harness may connect each wing pitch controller to its respective wing assemblies 103, enabling manipulation of the rods (not shown) attached to each the wings 106, and thus manual adjustment of the pitch angle of each wing 106. A rudder (not shown) may also be implemented as part of the boat stabilizer 102 assembly, to allow for the attached vessel to be steered in the absence of a preexisting, functional steering mechanism. This rudder may be controlled by a passenger through means comparable to those used in the industry but must be a proper length such that it is always partially submerged in the water, despite any lift imparted on the vessel, and be capable of being rotated out of the water, much like the wing assemblies 103. The rudder may be attached to the upper harness 104 by an orientation lock (not shown) in such a way that the rudder is positioned of off the stern side of the attached vessel.

The implementation of a boat stabilizer on a vessel allows for the force exerted on the wings 106 while traveling forward to be converted into a lift force being applied to the attached vessel. When the vessel is elevated higher, it may experience less turbulence from the waves below, reducing both the likelihood and severity of seasickness in susceptible passengers. The elevation of the vessel higher above the waves may also have the added benefit of reducing both wave impact strength and frequency on the vessel hull, effectively improving vessel longevity. The elevation of the vessel higher out of the water reduces the water/vessel interface area, reducing the amount drag experienced by the vessel, and potentially increasing its speed, travel distance and fuel mileage, as applicable. The feature of active wing 106 pitch angle adjustment may provide safety benefits under strong wind, rough water or other hazardous conditions by allowing each wing to be adjusted at will to compensate for environmental factors to help keep the vessel upright, level and stable. Being able to deploy or withdraw the wings assemblies 103 to and from the water provides the vessel with additional versatility where sub-vessel clearance may become an issue. The versatility of the boat stabilizer 102 allows it to be incorporated into many different types of vessels, such that they may be enhanced by the benefits provided by this technology. Additionally, the modular nature of the boat stabilizer 102 may allow for easier modification or repair of components, when compared to existing technology.

The elements of the boat stabilizer 102 may be connected accordingly to allow for the required element functionality. The beams of the upper harness may be welded together or attached through similar means. The upper harness may be attached to the vessel by using rivets, welding, or other suitable method. Pivot joints capable of rotating about a singular axis may be used in the connection of various elements, including the connections between the rods and rod junctions, rods and wings 106, rod junctions and assembly control system, and wing poles 107 and wings 106. Each wing angle controllers is connected to its respective wing assemblies by a cable within a cable pulley system (not shown) to allow for manipulation of the wing pitch angle through usage of its attached handle, while also having its base suitably attached to the upper harness, through welding or comparable means. The control pole (not shown) may connect to the upper harness by being welded to an orientation lock, such that the rotation of the control pole results in the rotation of the whole wing assembly 103. In another example, the control pole may be included as part of the wing pole, with the resultant combined wing pole being attached to both the wing mount and the orientation lock. A rudder may also be connected to the upper harness 104 similarly to the control poles using an orientation lock such that it may also be manually rotated to and from the water at will. Due to the boat stabilizer 102 being composed of various unique and separable elements, the system may have many of its pieces modified or replaced with relative ease compared to many current technologies.

Figure 2A:
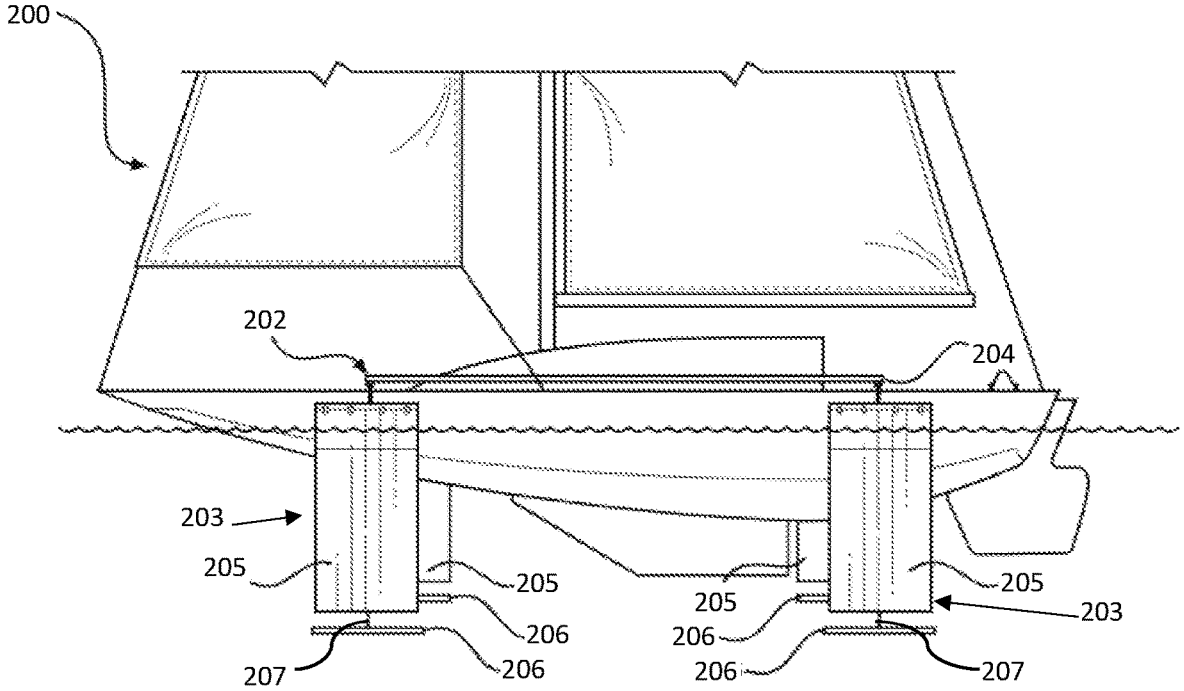
FIG. 2A-2C illustrate the side view and top view of a sailboat with a boat stabilizer installed according to an aspect.
Figure 2B:
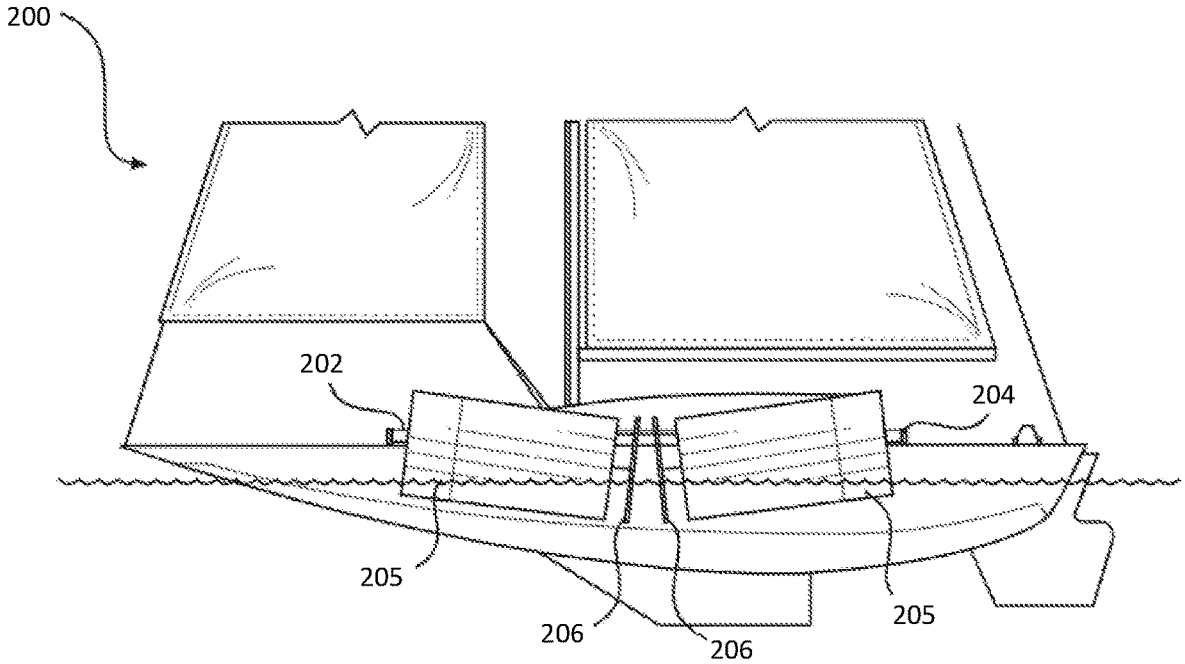
Figure 2C:
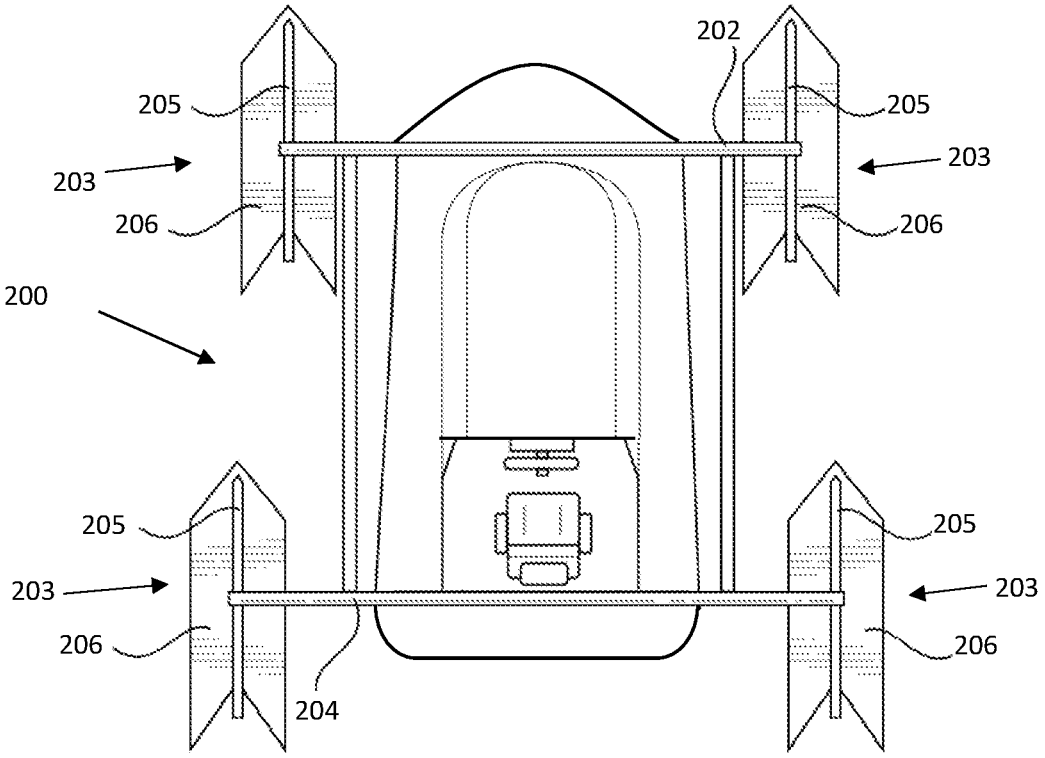
Figure 3A:
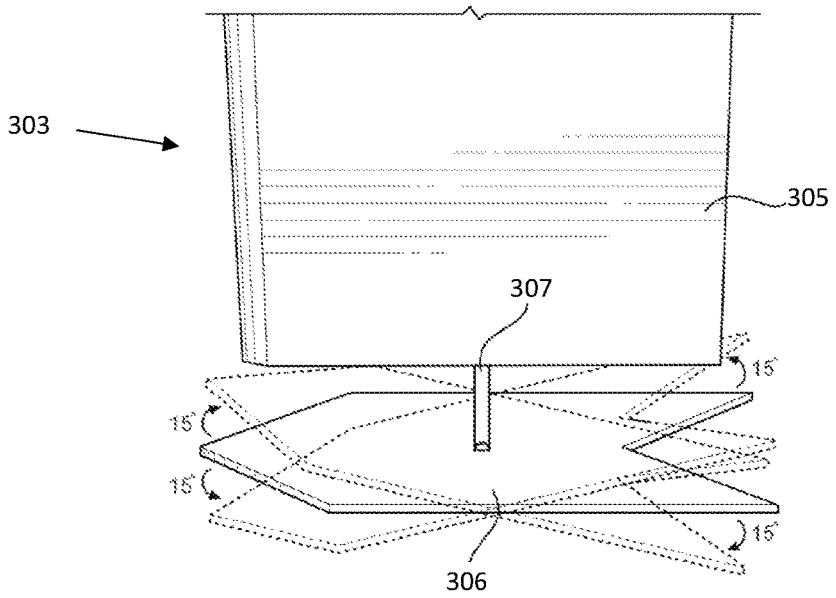
FIG. 3A-3F illustrate the side perspective view of wing assemblies of a boat stabilizer, according to an aspect.
Figure 3B:
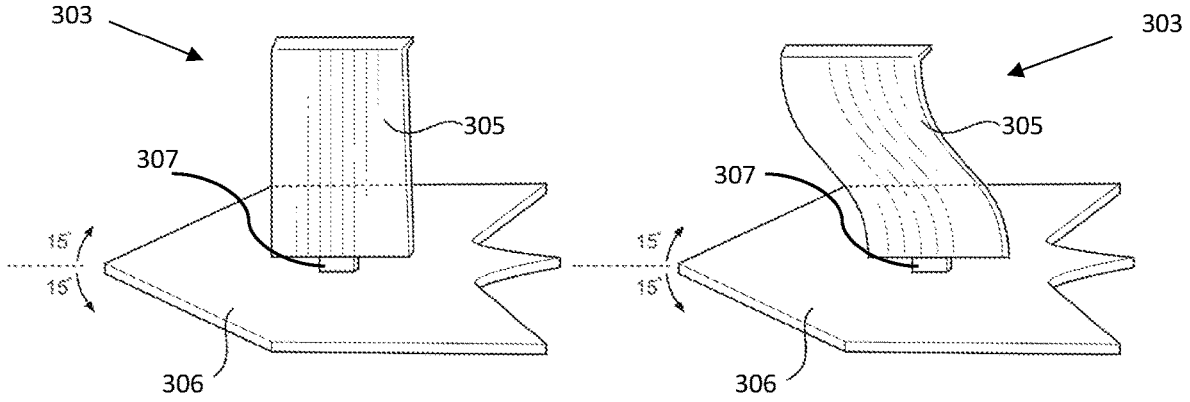
Figure 3C:
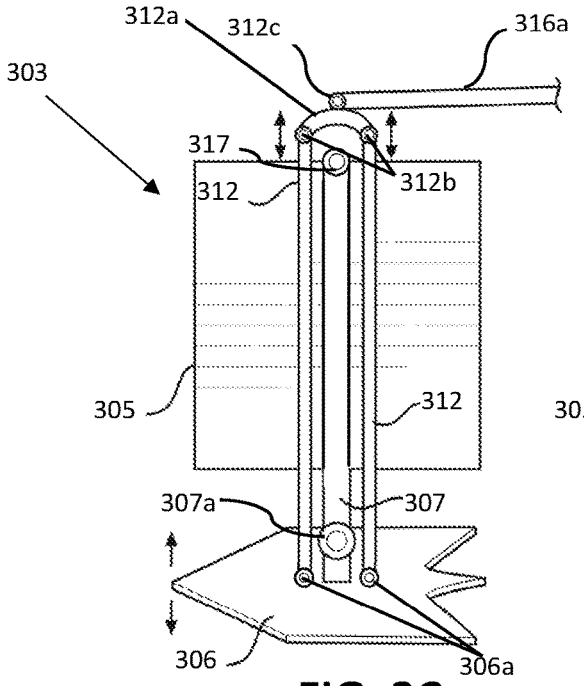
Figure 3D:
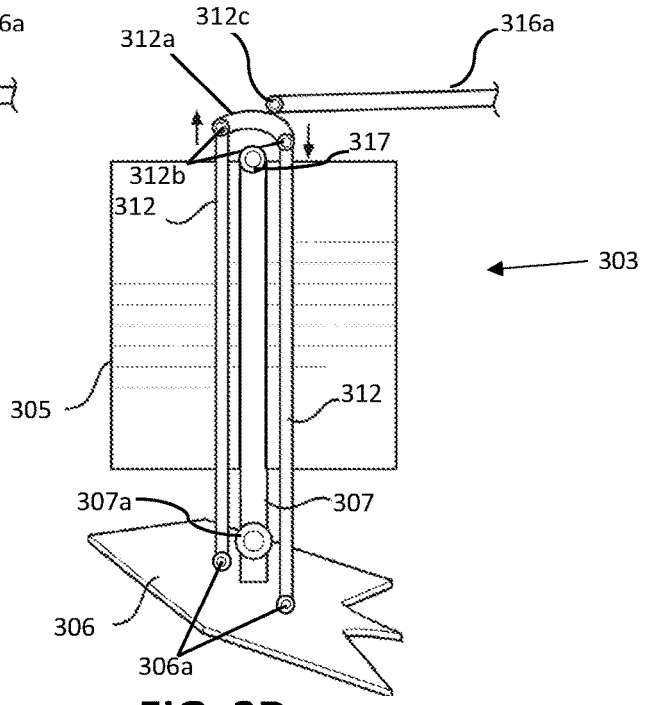
Figure 3E:
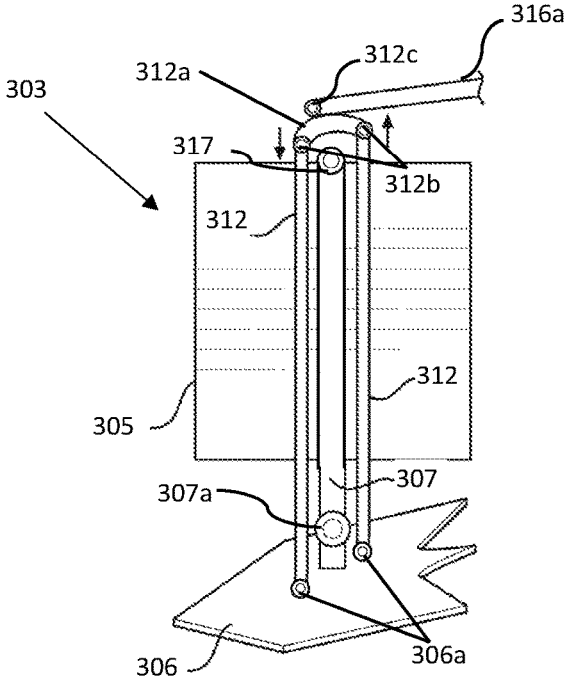
Figure 3F:
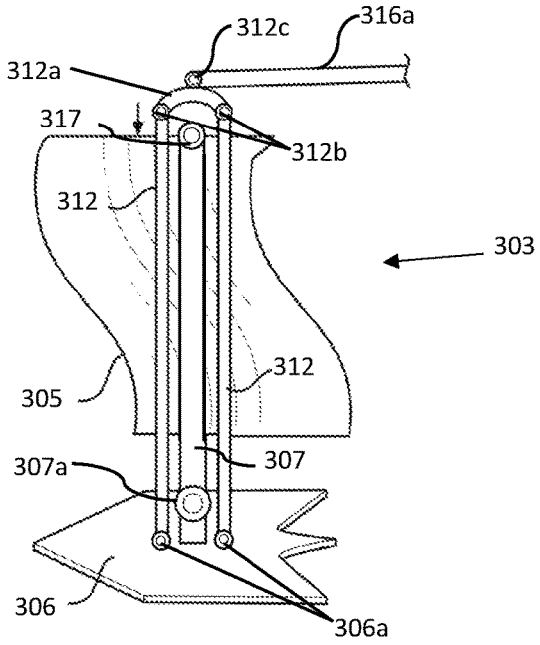

FIG. 2A—2C illustrate the side views and top view of a sailboat 200 with a boat stabilizer 202 installed, according to an aspect. The boat stabilizer described herein may be set in different positions through rotation of its wing assemblies 203, including its operational position, with the wing assemblies 203 rotated vertically with their wings 206 submerged in the water as they are in FIG. 2A, or its nonoperational position, with the wing assemblies 203 rotated horizontally as they are in FIG. 2B. The hereinabove described wing assembly rotation is enabled through the implementation of orientation locks (not shown) between each wing assembly 203 and the upper harness 204 assembly. In its operational position, the boat stabilizer 202 can adjust the pitch angles of both port side wings 206 or both starboard side wings 206 through manipulation of the appropriate wing angle controller. One advantage of this is that the boat stabilizer 202 may be able to compensate for strong winds or other conditions to ensure that the attached vessel remains upright, stable, level and does not capsize, while significantly reducing the turbulence experienced for passengers on the boat. In addition to the inherent safety benefits of keeping the boat more stable despite environmental conditions, this increased stability may also help reduce the likelihood and/or severity of seasickness cases for passengers. Due to the lifting of the vessel that may occur as a result of the installed boat stabilizer 202, the boat may also be risen above potentially rough waters. One result of this is that the vessel may experience less strain, wear and tear that may result from repeated impact of the vessel with the surface of the water that may occur when riding in rougher waters. The lifting of the vessel partially out of the water may help increase the longevity of the vessel while simultaneously providing a smoother, safer ride.

Aside from the passenger safety and vessel longevity benefits described above, the boat stabilizer 202 may also provide advantages for the vessel in terms of its efficiency. Since the angle of the wings 206 may result in a lift force being applied to the attached vessel, the amount of drag experienced by the vessel as it travels through the water may be reduced as a result of the reduction of water/vessel interface area. The reduction of drag on the vessel during travel allows a supplied propulsion method, including an attached sail or motor unit, to propel the boat with greater efficacy. This may result in faster speeds and greater travel distances for most types of vessels, including sailboats, and additionally enhanced fuel milage for vessels with fuel-based propulsion methods.

As can be seen in FIG. 2C, the upper harness 204 is implemented to its attached boat 200 in such a way that the wing mounts 205 and their attached wings 206 are positioned at the perimeter of the boat, with the bow side wings 206 spanning beyond the front of the vessel bow and stern side wings 206 spanning beyond the back of the vessel stern. The placement of these wings 206 at perimeter of the boat helps to ensure that the lift force that may be applied to the vessel is applied in a balanced manner, rather than to just one portion of the boat. This method of placing the wing mounts 205 beyond the perimeter of the vessel provides the vessel with a more widely spread lengthwise contact surface with the water, and thus provides greater stability. This method of positioning the wing mounts 205 at the perimeter of the vessel is the preferred method of wing mount 205 positioning, due to the greater resultant vessel stability.

FIG. 3A-3F illustrate the side perspective views and side cross-sectional views of wing assemblies 303 of a boat stabilizer, according to an aspect. It should be understood that for the purposes of clarity certain elements of the wing assembly are omitted from each figure in order to better articulate the characteristics and functionalities of each element. The wings 306 are capable of being pitched upward or downward in order to achieve the desired effect on vessel operation, whether that be compensation for wind or water conditions, or optimization of vessel lift. The suggested operational pitch angle of a wing is about +/−15 degrees from the horizontal position. Each wing 306 is connected to two rods 312, with both rods connected to a rod junction 312*a* by pivot joints 312*b* such that the rods may be adjusted to control wing pitch without changing their orientation. The wing pole 307 is attached to the wing 306 by a wing pivot joint 307*a*, such that the wing pole 307 may also retain its orientation, despite the angling of the wing. As seen in FIG. 3C-3F, the control pole (not shown) may be integrated into the wing pole 307, such that the wing pole 307 may attach the wing mount directly to the orientation lock 317. Both rods 312 are partially disposed within a wing mount 305, which they travel through along its length. Both rods 312 may be connected to their respective wing by wing pivot joints 306*a*, such that they may be manipulated to change the pitch angle of the connected wing, without changing their orientation. The rod junction 312*a* is connected to a wing angle controller (not shown) implemented as part of the assembly control system by a control joint 312*c*. This control joint 312*c* allows for rotation of the rod junction 312*a* through manipulation of an attached cable pulley system 316*a* controlled by its connected wing angle controller. A singular wing pitch angle controller (not shown) may be used to simultaneously manipulate both wings 306 on either the port side or the starboard side of the vessel, such that one wing pitch angle controller may control both port side wings 306 and a second wing pitch angle controller may control both starboard side wings 306. Though manual manipulation of cables may be used in the disclosed boat stabilizer to adjust the wing angle, one may also choose to implement electric elements, such as motors, for wing pitch adjustment.

As shown through FIG. 3A through FIG. 3F, both the wings 306 and wing mounts 305 may be implemented in a variety of shapes and styles as needed. The shape of wing mounts may be modified to be curved, as they are in FIG. 3F, straight, as they are in FIG. 3C, or potentially other shapes as needed. The preferred shape for a wing mount is the curved variant of FIG. 3F, which has superior hydrodynamic properties when compared to the straight mount, resulting in less drag. The same variability may also be applied to the wings 306, which may be "bird shaped" as they are in FIG. 3B, chevron shaped as are in FIG. 3A, or potentially other shapes as needed. The preferred shape for a wing is the "bird shaped" variant of FIG. 3B, which has a larger surface area that helps to better control the vessel during travel. Furthermore, the preferred combination may be seen in FIG. 3F, which implements a "bird shaped" wing and curved wing mount. Further variation of the shapes of the wings 306 and wing mounts 305 may allow for a more durable construction, lighter weight, greater lift, or a variety of other improvements.

Figure 4:
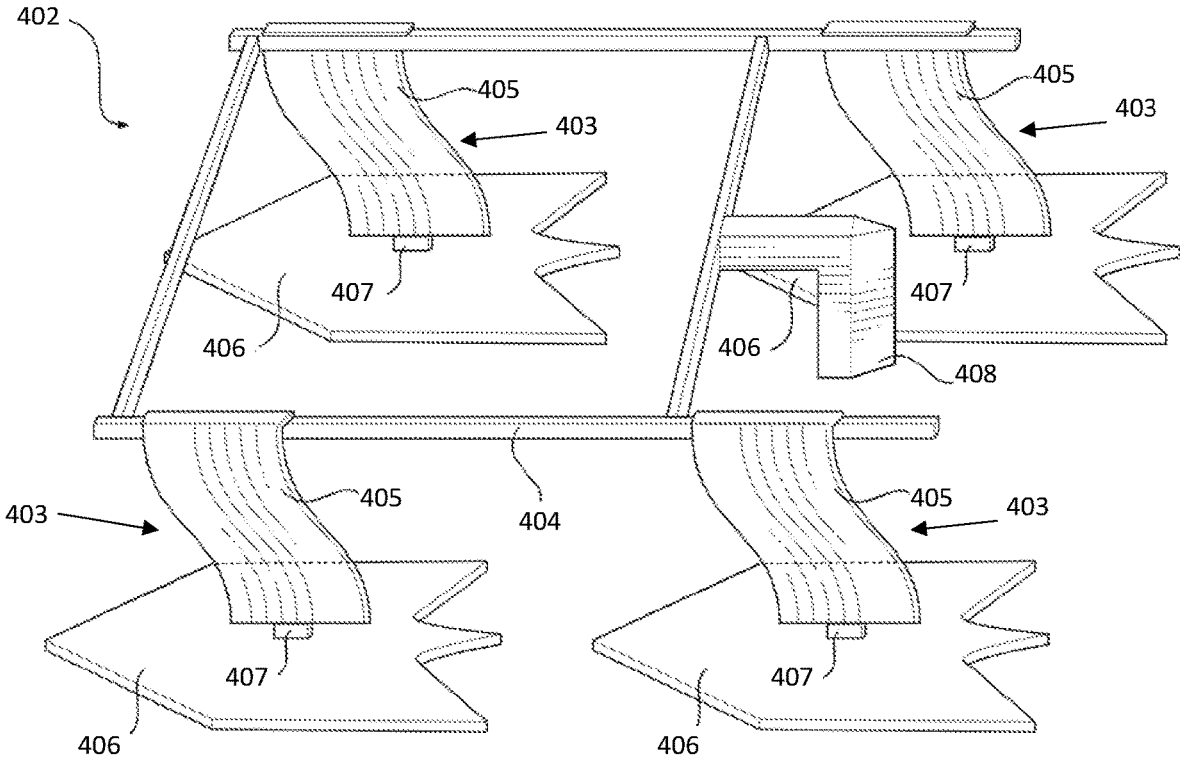
FIG. 4 illustrates the side perspective view of a boat stabilizer, according to an aspect.

FIG. 4 illustrates the side perspective view of a boat stabilizer 402, according to an aspect. As mentioned, it should be understood that certain elements are not shown in this figure for purposes of simplification. The boat stabilizer 402 may be provided as a kit and be implemented as a removeable part of a vessel, with minimal modifications required to the vessel itself. The boat stabilizer 402 may also be built into the vessel itself during vessel construction. While the lift provided to the vessel by the boat stabilizer 402 may provide a wide array of benefits, it may also result in preexisting steering mechanisms being lifted fully out of the water. In order to compensate for this, an attached rudder 408 may be used to direct the vessel during travel. The single rudder assembly provided may be attached to the upper harness 404 in such a way that it may be rotated out of the water, such as by incorporating an orientation lock (not shown), much like those described for use with the wing assemblies 403. The rudder 408 is of such a length that even while the attached vessel is lifted above the water's surface during travel, the rudder 408 will be partially submerged to provide directional control to the vessel. The mechanism through which the rudder 408 enables steering for the vessel is similar to those found in the industry and may be adjusted manually by onboard personnel. As noted previously, the rudder 408 may be positioned behind the stern of the vessel.

The usage of an assembly control system (not shown) may allow for the adjustment of wing 406 pitch angle through manipulation of the wing pitch controllers, and the deployment and withdrawal of the wing assemblies 403 into and out of the water through manual manipulation of their orientation locks (not shown). This assembly control system may adjust the boat stabilizer elements manually, electronically, through inputted user commands, or autonomously through an automated system. This may include incorporation of electric motor systems placed at the top of the wing assemblies 403 that may adjust both the wing 406 pitch and wing assembly 403 angles.

Figure 5A:
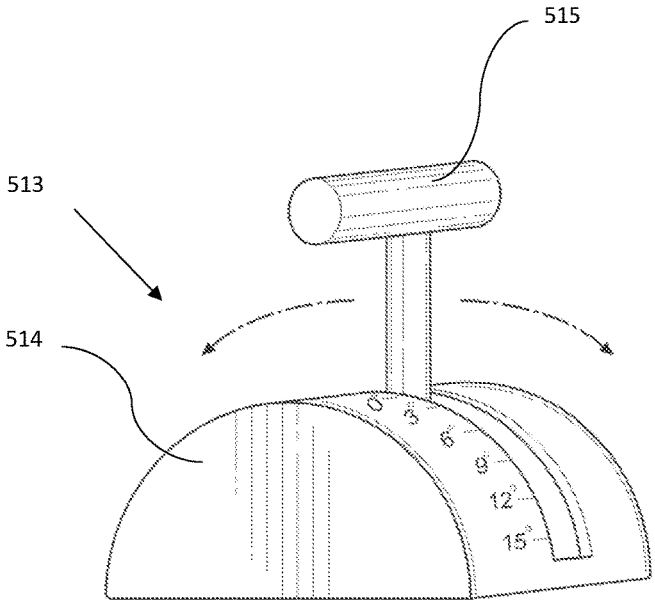
FIG. 5A-5B illustrate the side perspective and top view of a rounded wing pitch angle controller respectively, according to an aspect.
Figure 5B:
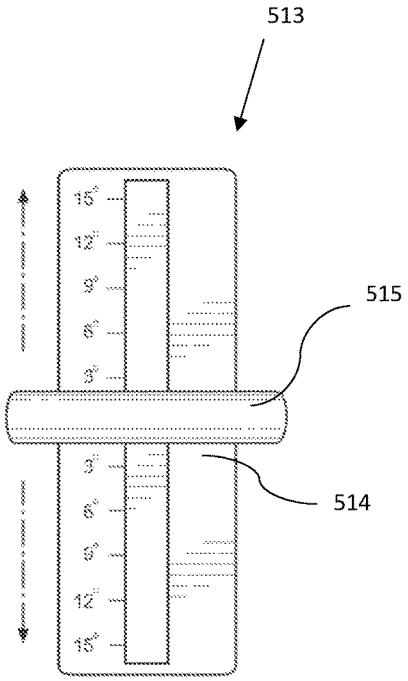

FIGS. 5A and 5B illustrate the side perspective and top view of a rounded wing pitch angle controller 513 respectively, according to an aspect. A wing pitch angle controller 513, comprised of a controller base 514 and handle 515, may be used in order to manipulate the wings located on the wing assemblies. One wing pitch angle controller 513 may be used to control both of the wings on either the port side or the starboard side of the vessel. Both wing assemblies on the port or starboard side may have a wing angle controller 513 connected to their respective rod junctions by a cable 516 to allow for wing adjustments to be made to two wing assemblies simultaneously. Each wing angle controller 513 may be connected by its base 514 to the upper harness by welding or other suitable means. Manipulation of the handle 515 may move the cable within a cable pully system (not shown) to apply a rotational force upon its respective rod junctions (not shown) to change the wing pitch angles on either the port or starboard side wing assemblies (not shown).

The capability of the boat stabilizer to manipulate the wing pitch angles of the port and starboard sides of the vessel independently of each other provides it with certain benefits. Vessels with uneven weight distributions may adjust each of the wings during travel to ensure that the vessel remains upright, level, and comfortable. Such an instance may occur if a vessel needed to carry a piece of cargo of significant weight, without having anything to use as a counterweight. Also, as mentioned previously, in the event of weather or water conditions that may rock the vessel, the individual wing adjustments may also help to compensate for these forces. While the wing pitch angle controllers described herein use only manual mechanisms for wing pitch angle adjustment, one may also implement comparable electronic mechanisms to achieve the same results, such as including a motor with an electronic controller.

Figure 6A:
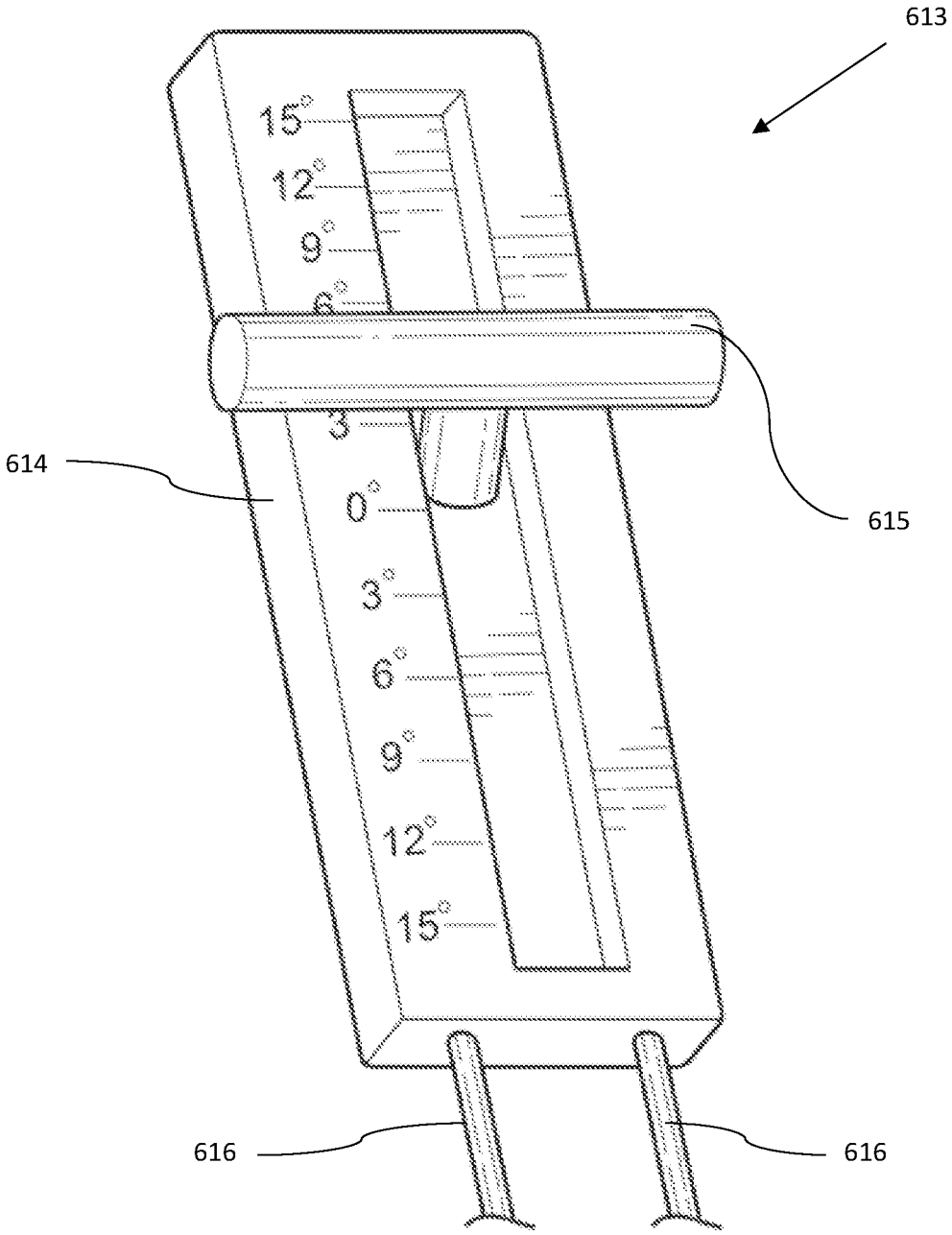
FIG. 6A-6C illustrate the top perspective view of a rectangular wing pitch angle controller connected to a cable and side cross sectional views of a rectangular wing pitch angle controller attached to wing assemblies, respectively, according to an aspect.
Figure 6B:
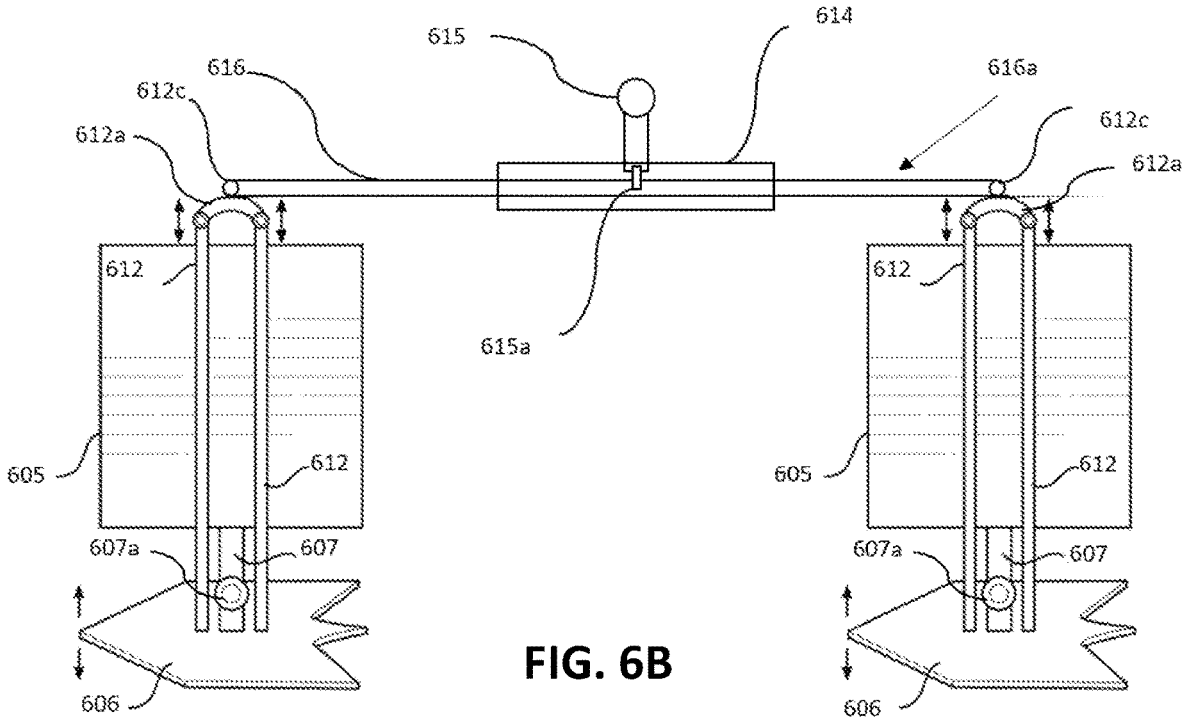
Figure 6C:
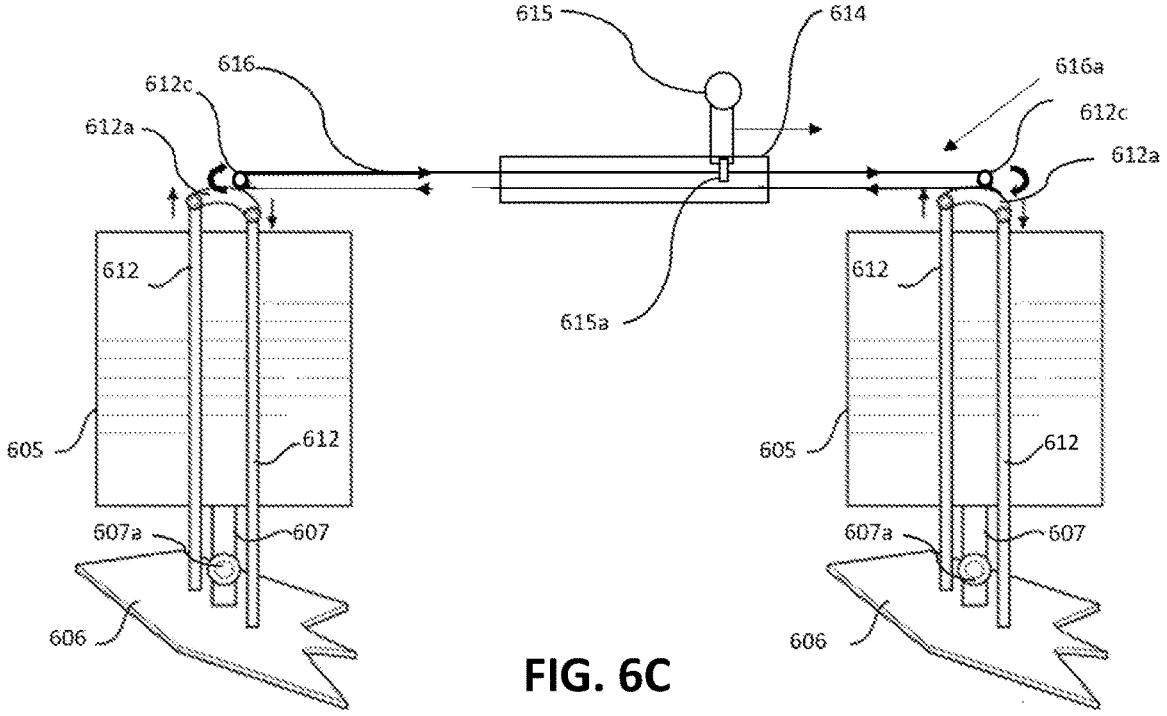

FIG. 6A-6C illustrate the top perspective view of a rectangular wing pitch angle controller 613 connected to a cable 616 and a side cross sectional views of a rectangular wing pitch angle controller 613 attached to wing assemblies 603, respectively, according to an aspect. The shape of the controller base may be varied to be rounded as it was in FIG. 5 or rectangular it is in FIG. 6A—6C, as long as its intended functionality is not hampered. As mentioned above, the wing pitch angle controller 613 may change the wing pitch angles through manipulation of an attached handle 615. This handle 615 connects to the incorporated cable 616, which may be connected to two rod junctions 612*a* by their control joints 612*c*. The cable 616 may be implementation as part of a cable pulley system 616*a*. The cable 616 may be connected to the handle 615 by a handle link 615*a*. The cable pulley system may be arranged such that manual manipulation of the handle 615 results with a corresponding rotational force being applied to the rod junctions, through the rotation of the cable 616 along the cable pulley system 616*a*. This in turn may result in the wings 606 being pitched downward from moving the handle 615 in one direction, and the wings 606 being pitched upward from moving the handle 615 in the other direction, as seen in FIG. 6C.

Figure 7A:
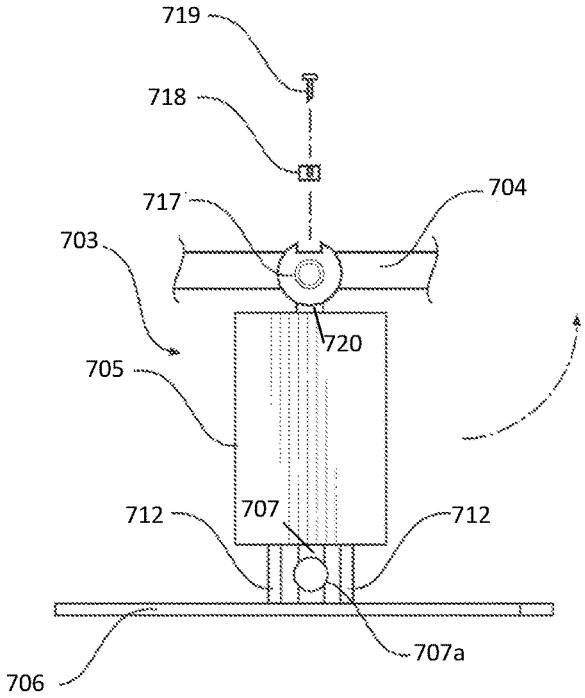
FIG. 7A-7B illustrate side perspective views of a wing assembly with an orientation lock, according to an aspect.
Figure 7B:
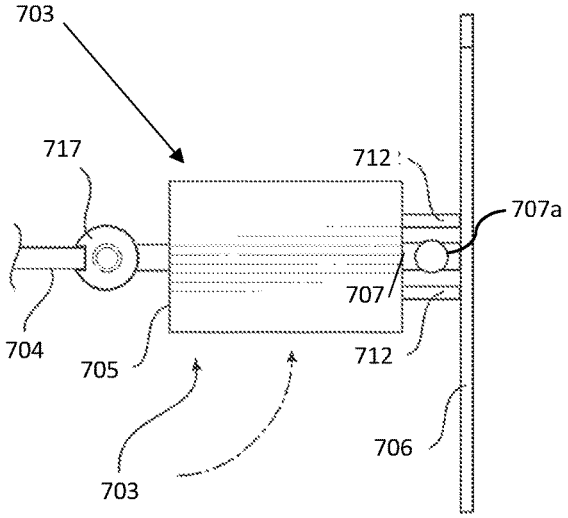

FIG. 7A—7B illustrate side perspective views of a wing assembly with an orientation lock, according to an aspect. A key feature of this invention is the ability to deploy and withdraw the wing assemblies 703 to and from the water as needed. This feature is enabled through the implementation of orientation locks between each of the wing assemblies and the upper harness 704. The orientation locks may be comprised of a rotation couple 717 fitted around an end section of the upper harness, a locking key 718 and a locking screw 719. The wing mount 705 may be attached to the rotation couple 717 by a control pole 720, having a bottom portion attached to the wing mount and a top portion attached to the rotation couple. The rotation couple 717 may rotate freely when the locking key 718 and locking screw 719 are not installed. Upon installation of the locking key 718 and locking screw 719, the rotation couple 717 will no longer be able to rotate. By attaching the rotation couple 717 to an end section of the upper harness 704 and the wing pole 720 of a wing assembly 703, the rotational orientation of the wing assemblies 703 may be changed manually through the removal of the locking key 718 and screw 719, manual rotation of a wing assemblies 703 to the desired orientation and subsequent reinstallation of the locking key 718 and screw 719. As described previously orientation locks may also be attached to a rudder, to allow for its deployment or withdrawal as needed.

Figure 8:
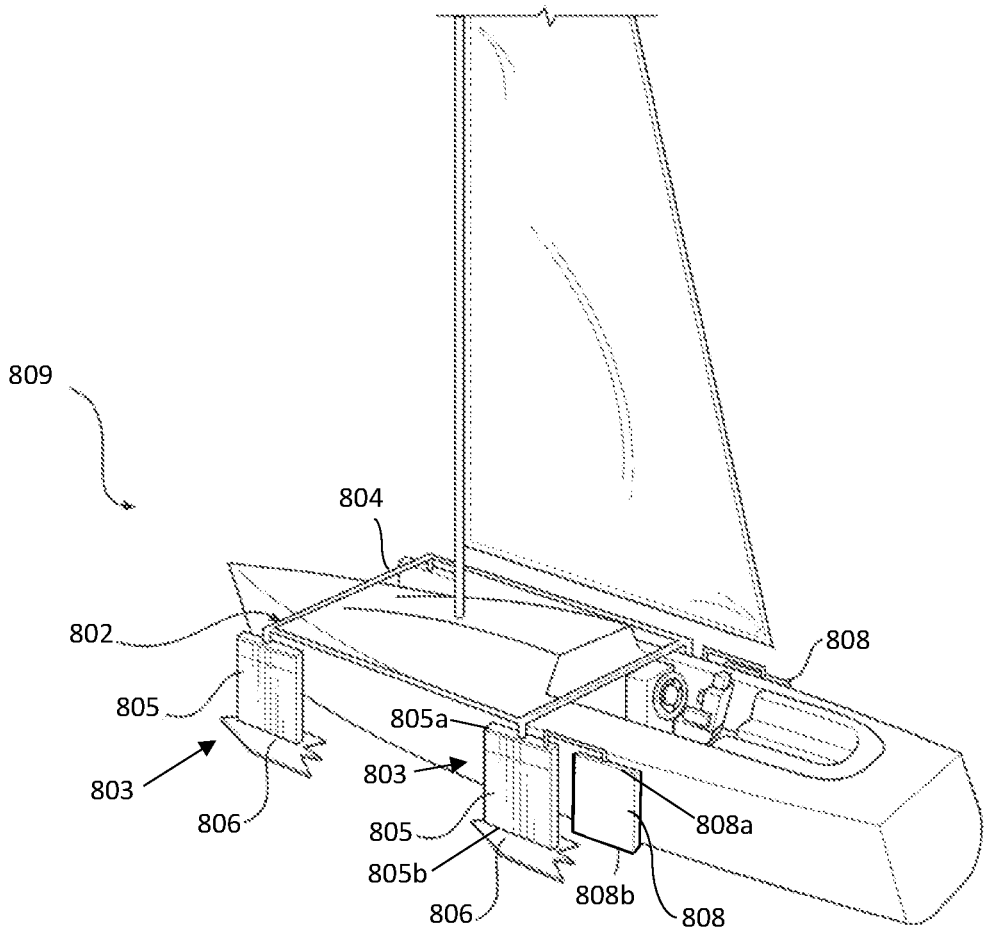
FIG. 8 illustrates the side view of a boat with a boat stabilizer installed, the boat stabilizer having two rudders, according to an aspect.

FIG. 8 illustrates the side view of a boat 809 with a boat stabilizer 802 installed, the boat stabilizer having two rudders 808, according to an aspect. As discussed previously, the lift provided by a boat stabilizer 802 may result in the lifting of preexisting steering methods, which may result in these steering methods becoming less efficient or entirely ineffective. In order to alleviate this potential issue, one or more rudders 808 may be implemented as part of the boat stabilizer 802 assembly. Much like the previously described rudders, these dual rudders 808 may be adjusted to provide steering means through mechanisms comparable to those present in the industry. Each rudder 808 may be implemented behind and attached to different stern side wing mount 805 at the stern of the vessel. The length of these dual rudders 808 is such that when the boat stabilizer 802 is in its operational position, the top edges of the rudders 808*a* align with the top edges of the wing mounts 805*a*, but the bottom edges of the rudders 808*b* are above the bottom edges of the wing mounts 805*b*. This is done in order to prevent the collision of the wing 806 with the rudders 808 during wing pitch and rudder adjustment.

As with the single rudder configurations described above, the rudders used with this assembly need to be of such a length that part of the rudders are submerged during travel, even with the associated lift, to provide directional control during travel. Additionally, the shape these rudders 808 behind the stern side wing mounts may be the same as their respective wing mounts 805, such that curved wing mounts have curved rudders, and straight wing mounts 805 have straight rudders 808. This will allow the rudders to be fit more closely to their respective wing mounts 805 while maximizing stern side clearance. While both the single and dual rudder layouts may be viable, the dual rudder 808 layout is preferred, as it provides superior steering control. Additionally, these dual rudders 808, may be rotated out of the water as a result of their attachment to the wing assemblies 803, removing the need for an additional rudder withdrawal mechanism. These rudders 808 may be the sole means of controlling vessel direction or be used in conjunction with other preexisting, operational directional control methods.

Figure 9:
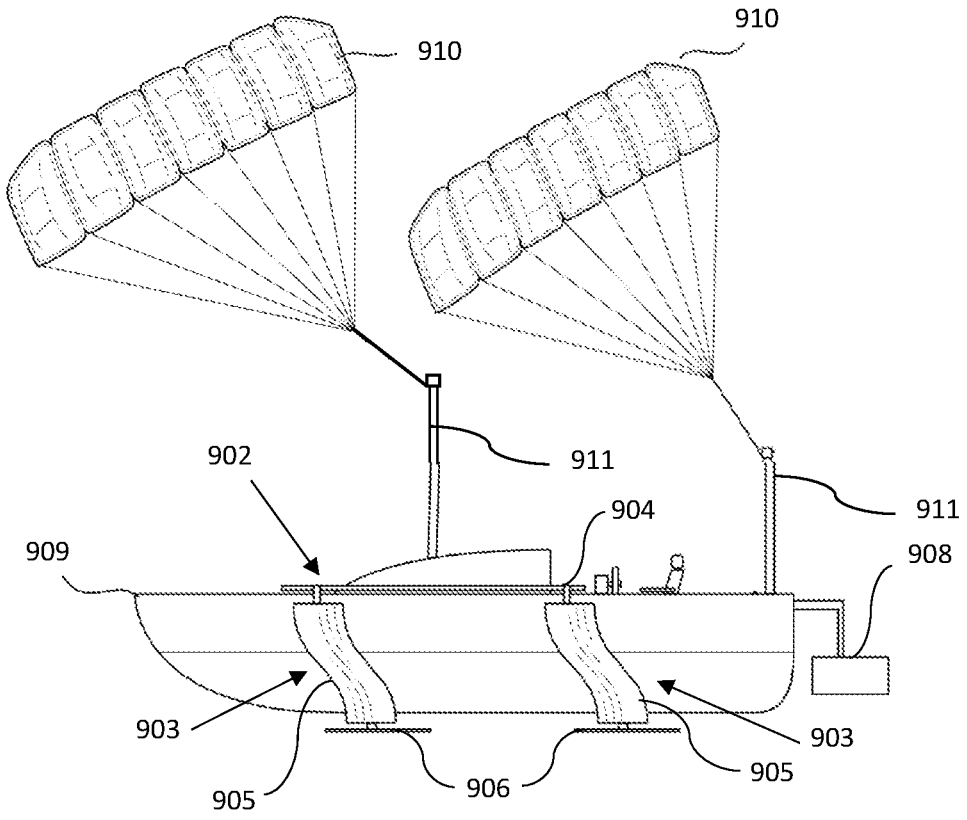
FIG. 9 illustrates the side view of a boat with a boat stabilizer and parasails installed, according to an aspect.

FIG. 9 illustrates the side view of a boat 909 with a boat stabilizer 902 and parasails 910 installed, according to an aspect. Additional peripherals may be implemented alongside a boat stabilizer 902, or potentially as part of the boat stabilizer 902, to make use of its provided benefits. One such peripheral is a parasail 910, which may be attached to the top of a vessel by an installed parasail mount 911 included as part of the vessel or boat stabilizer 902 assembly. A parasail 910 may be implemented to take advantage of the propulsive force of air currents. The parasails 910 may be able to take advantage of the propulsive forces of higher elevation winds than a conventional sail, depending on the length of their attached cord. When implemented on a vessel, parasails 910 may provide a vessel with an additional propulsion method that is similar to that of a conventional sailboat. Reduction of drag on the vessel as a result of lifting the vessel partially out of the water may allow the force provided by a parasail 910 to be used more efficiently. This may result in maintenance of higher vessel speeds as well as greater resultant distances traveled. A rudder 908 may be present on the on the vessel or boat stabilizer and positioned off the stern of the vessel and partially submerged in the water during travel. The rudder 908 may be used to direct the vessel during travel and may be incorporated as part of a boat stabilizer in the absence of, or in addition to, preexisting directional control methods on the vessel. This rudder 908 may need to be of a sufficient length to be partially submerged during travel, regardless of the potentially increased elevation of the vessel above the surface of the water.

Figure 10:
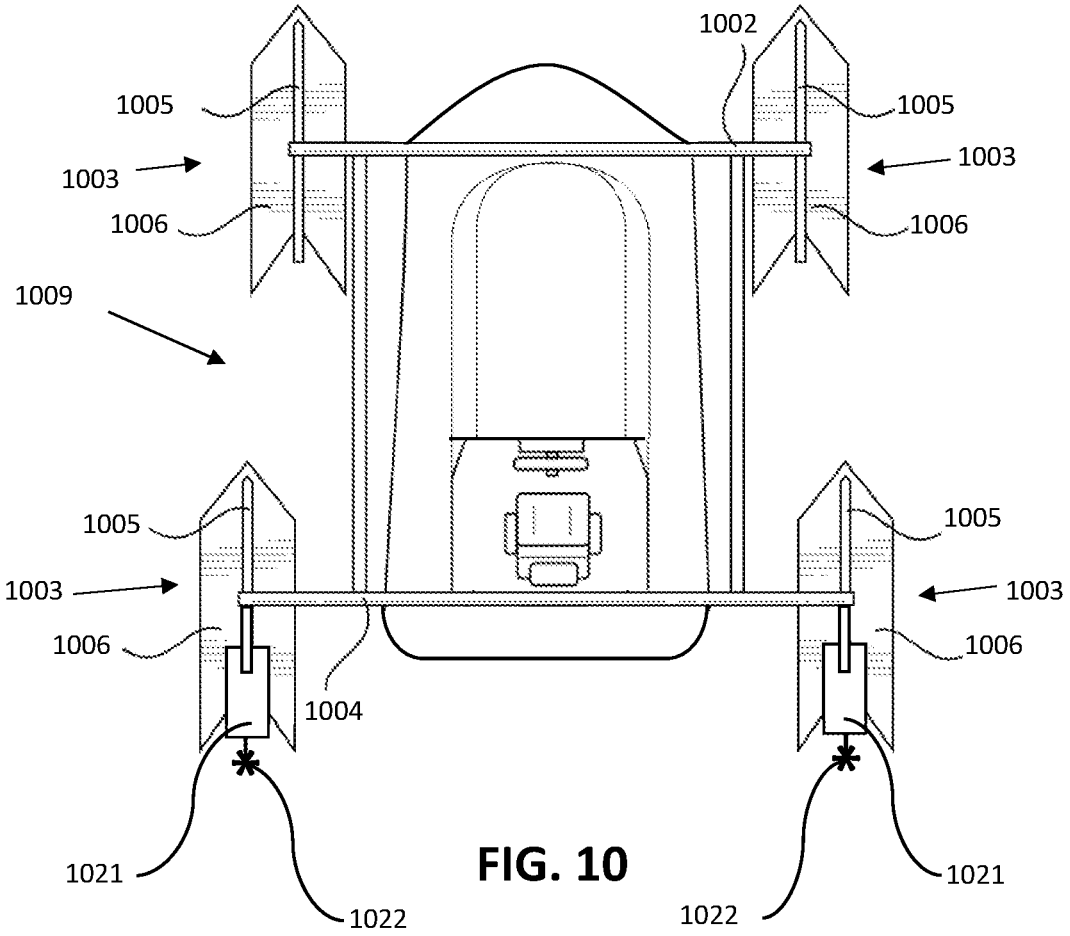
FIG. 10 illustrates the top view of a boat with a boat stabilizer having two electric motors with propellers installed, according to an aspect.

FIG. 10 illustrates the top view of a boat 1009 with a boat stabilizer 1002 and two electric motors 1021 with propellers 1022 installed, according to an aspect. As with the parasails (not shown) incorporated previously, many different methods of propulsion may be incorporated into a boat stabilizer 1002 assembly. A propulsion method that may provide a significant amount of utility in a variety of environments is an electric motor 1021 with attached propeller 1022. One may attach one electric motor 1021 to each stern side wing 1006 and connect a propeller 1022 onto each motor 1021, such that spinning of the propeller 1022 by the motor 1021 provides forward propulsion to the attached boat 1009. Due to the positioning of each electric motor 1022 on stern side wings, the lowest elements of the boat stabilizer 1002 during operation, this dual motor 1021 propulsion method may always be available capable of propelling the vessel, regardless of the amount of lift provided to the vessel and provide more vessel stability than a single motor assembly could. Theses dual motors 1021 with propellers 1022 may be implemented as an additional source of propulsion in the presence of functional propulsion methods on the boat stabilizer or vessel, or the sole means of propulsion in the absence of other functional or present propulsion methods. Also, like the hereinabove rudders, these motors 1021 and propellers 1022 must be positioned in such a way that they are properly submerged during operation, in order to be able to provide their desired function. The electric motors 1021 may be controlled by an onboard control device, comparable to those used in the industry and be attached to their respective wings 1006 through welding or equivalent methods.

It may be advantageous to set forth definitions of certain words and phrases used in this patent document. The term "couple" and its derivatives refer to any direct or indirect communication between two or more elements, whether or not those elements are in physical contact with one another. The term "or" is inclusive, meaning and/or. The phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like.

Further, as used in this application, "plurality" means two or more. A "set" of items may include one or more of such items. Whether in the written description or the claims, the terms "comprising," "including," "carrying," "having," "containing," "involving," and the like are to be understood to be open-ended, i.e., to mean including but not limited to. Only the transitional phrases "consisting of" and "consisting essentially of," respectively, are closed or semi-closed transitional phrases with respect to claims.

If present, use of ordinal terms such as "first," "second," "third," etc., in the claims to modify a claim element does not by itself connote any priority, precedence or order of one claim element over another or the temporal order in which acts of a method are performed. These terms are used merely as labels to distinguish one claim element having a certain name from another element having a same name (but for use of the ordinal term) to distinguish the claim elements. As used in this application, "and/or" means that the listed items are alternatives, but the alternatives also include any combination of the listed items.

The term "bird shape" used within this application is defined as an arrowhead shape with an additional point at its rear, pointing opposite from the forward-facing tip, and disposed between and aligning with the two back facing points. Nautical terminology used within this application is understood to retain its known meanings including "bow" referring to the front of the vessel, "stern" referring to the back of the vessel, "port' referring to the left of the vessel and "starboard" referring to the right of the vessel.

Throughout this description, the aspects, embodiments or examples shown should be considered as exemplars, rather than limitations on the apparatus or procedures disclosed or claimed. Although some of the examples may involve specific combinations of method acts or system elements, it should be understood that those acts and those elements may be combined in other ways to accomplish the same objectives.

Acts, elements and features discussed only in connection with one aspect, embodiment or example are not intended to be excluded from a similar role(s) in other aspects, embodiments or examples.

Aspects, embodiments or examples of the invention may be described as processes, which are usually depicted using a flowchart, a flow diagram, a structure diagram, or a block diagram. Although a flowchart may depict the operations as a sequential process, many of the operations can be performed in parallel or concurrently. In addition, the order of the operations may be re-arranged. With regard to flowcharts, it should be understood that additional and fewer steps may be taken, and the steps as shown may be combined or further refined to achieve the described methods.

If means-plus-function limitations are recited in the claims, the means are not intended to be limited to the means disclosed in this application for performing the recited function, but are intended to cover in scope any equivalent means, known now or later developed, for performing the recited function.

Claim limitations should be construed as means-plus-function limitations only if the claim recites the term "means" in association with a recited function.

If any presented, the claims directed to a method and/or process should not be limited to the performance of their steps in the order written, and one skilled in the art can readily appreciate that the sequences may be varied and still remain within the spirit and scope of the present invention.

Although aspects, embodiments and/or examples have been illustrated and described herein, someone of ordinary skills in the art will easily detect alternate of the same and/or equivalent variations, which may be capable of achieving the same results, and which may be substituted for the aspects, embodiments and/or examples illustrated and described herein, without departing from the scope of the invention. Therefore, the scope of this application is intended to cover such alternate aspects, embodiments and/or examples. Hence, the scope of the invention is defined by the accompanying claims and their equivalents. Further, each and every claim is incorporated as further disclosure into the specification.

What is claimed is:

1. A boat stabilizer, the boat stabilizer comprising:

an upper harness for attachment to a vessel, the vessel having a bow side, a stern side, a port side and a starboard side, the upper harness having:

a bow beam running straight across the bow side of the vessel and beyond the port and starboard sides of the vessel, terminating in port and starboard end sections respectively;

a stern beam running straight across the stern side of the vessel and beyond the port and starboard sides of the vessel, terminating in port and starboard end sections respectively;

a port beam connecting the port side end sections of the bow and stern beams;

a starboard beam connecting the starboard side end sections of the bow and stern beams;

an assembly control system having four orientation locks, each one attached to a different end section and comprising a rotation couple, a locking key and a locking screw, and two wing angle controllers, each having a base and a handle, with the base attached to one of the upper harness beams and the handle attached to the base and four wing assemblies, each one attached to a different orientation lock and comprising:

a rod junction, having an upper central portion attached to a corresponding wing angle controller by a control pivot joint, a front end pivot joint and a back end pivot joint;

a front rod and a back rod, each rod having a top portion attached to a corresponding end pivot joint, a middle section and a bottom section;

a wing having a front portion, a back portion, a central mount located between the front and back portion, a front mount on the front portion and attached to the bottom section of the front rod, and a back mount on the back portion attached to the back rod by the bottom section of the back rod;

a wing pole having a bottom end attached to the central mount by a wing pivot joint, and a top end;

a wing mount attached to the wing pole, the wing mount having a bottom part, a front part having a sharpened edge, a back part, a top part, a front slot surrounding the middle section of the front rod and a back slot surrounding the middle section of the back rod; and a control pole having a bottom end attached to the top part of the wing mount and top end attached to the rotation couple of the corresponding orientation lock;

wherein each wing angle controller is configured to adjust pitch angles of their respective wings through manipulation of the wing angle controller handle;

wherein each orientation lock is configured to rotate the attached wing assembly through manipulation of the corresponding locking key and locking screw; and wherein the sharpened edges of the wing mounts face the same direction as the bow of the vessel when the wing assemblies are rotated below the vessel.

2. The boat stabilizer of claim 1, wherein the wings are bird shaped.

3. The boat stabilizer of claim 1, wherein the wing mounts are straight.

4. The boat stabilizer of claim 1, wherein the wing mounts are curved.

5. The boat stabilizer of claim 1, wherein bow side wings are positioned beyond the front of the vessel bow side and stern side wings are positioned beyond the back of the vessel stern side.

6. The boat stabilizer of claim 1 further comprising a rudder attached to the stern beam by an orientation lock.

7. The boat stabilizer of claim 1, further comprising two rudders attached to wing mounts.

8. The boat stabilizer of claim 7, wherein each rudder is disposed behind a different stern side wing mount.

9. The boat stabilizer of claim 8, wherein each rudder has the same shape as the attached wing mount.

10. A boat stabilizer, the boat stabilizer comprising:

an upper harness having:

a body comprised of a plurality of connected beams; and an assembly control system having two wing angle controllers and four orientation locks; and four wing assemblies attached to the body, each comprising:

a rod junction, having an upper central portion attached to a corresponding wing angle controller, a front end pivot joint and a back end pivot joint;

a front rod and a back rod, each rod having a top portion attached to a corresponding end pivot joint, a middle section and a bottom section;

a wing having a front portion, a back portion, a central mount located between the front and back portion, a front mount on the front portion and attached to the bottom section of the front rod, and a back mount on the back portion attached to the back rod by the bottom section of the back rod;

a wing pole having a bottom end attached to the central mount by a wing pivot joint, and a top end;

a wing mount attached to the wing pole, the wing mount having a bottom part, a front part, a back part, a top part and two slots, each slot surrounding a different rod by the middle section of the back rod; and a control pole having a bottom end attached to the top part of the wing mount and top end attached to a corresponding one of the orientation locks;

wherein each wing angle controller is configured to adjust pitch angles of their respective wing and wherein each orientation lock is configured to rotate the attached wing assembly.

11. The boat stabilizer of claim 10, further comprising a parasail attached to the upper harness.

12. The boat stabilizer of claim 10, further comprising two electric motors with attached propellers, each one attached to a different stern side wing.

13. The boat stabilizer of claim 10, wherein the adjustment of the pitch angle of the wings can be used to apply a lift force on the boat stabilizer in the presence of an external force.

14. The boat stabilizer of claim 10, wherein the adjustment of the pitch angle of the wings can be used to maintain a boat stabilizer stability in the presence of an external force.

15. The boat stabilizer of claim 10, further comprising a rudder attached to the upper harness by an orientation lock.

16. The boat stabilizer of claim 15, wherein the rudder is of such a length that when in use, the rudder is partially submerged into water, regardless of a lift force being imparted on the boat stabilizer.

17. A boat stabilizer comprising:

an upper harness having:

a body and;

an assembly control system having two wing angle controllers and four orientation locks; and four wing assemblies attached to the body, each comprising:

a rod junction, having an upper central portion attached to a corresponding wing angle controller, a front end couple and a back end couple;

a front rod and a back rod, each rod having a top portion attached to a corresponding end couple, a middle section and a bottom section;

a wing having a front portion, a back portion, a central mount located between the front and back portion, a front mount on the front portion and attached to the bottom section of the front rod, and a back mount on the back portion attached to the back rod by the bottom section of the back rod;

a wing pole having a bottom end attached to the central mount and a top end;

a wing mount attached to the wing pole, the wing mount having a bottom part, a front part, a back part and a top part; and a control pole having a bottom end attached to the top part of the wing mount and top end attached to a corresponding one of the orientation locks;

wherein the assembly control system is configured to adjust a pitch angle of each of the wings and to rotate each of the wing assemblies in and out of water.

18. The boat stabilizer of claim 17, wherein the pitch angle range of the wings is between about minus 15 degrees and plus 15 degrees of the horizontal.

19. The boat stabilizer of claim 17, further comprising a rudder attached to the body.

20. The boat stabilizer of claim 17, further comprising two rudders, each rudder being attached to a different wing mount.

* * * * *